US007393273B2

(12) United States Patent
Ehrman et al.

(10) Patent No.: US 7,393,273 B2
(45) Date of Patent: Jul. 1, 2008

(54) ROOF RIDGE VENT, ASSEMBLY AND METHOD OF INSTALLATION

(75) Inventors: Geoffrey N. Ehrman, Doylestown, PA (US); Michael S. Coulton, North Wales, PA (US); George Caruso, Ambler, PA (US); Daniel Cardone, Souderton, PA (US); Nathan L. Randello, Bensalem, PA (US); Anthony J. Le Storti, Doylestown, PA (US)

(73) Assignee: Benjamin Obdyke, Inc., Horsham, PA (US)

( * ) Notice: Subject to any disclaimer, the term of this patent is extended or adjusted under 35 U.S.C. 154(b) by 0 days.

(21) Appl. No.: 11/470,518

(22) Filed: Sep. 6, 2006

(65) Prior Publication Data

US 2007/0054612 A1 Mar. 8, 2007

Related U.S. Application Data

(60) Provisional application No. 60/714,558, filed on Sep. 7, 2005.

(51) Int. Cl.
*F24F 7/02* (2006.01)
*E04B 7/00* (2006.01)

(52) U.S. Cl. ..... 454/365; 52/198; 52/199

(58) Field of Classification Search ..... 454/364, 454/365, 366; 52/198, 199
See application file for complete search history.

(56) References Cited

U.S. PATENT DOCUMENTS 3,573,144 A * 3/1971 Anderson ..... 428/48
4,876,950 A 10/1989 Rudeen
4,942,699 A 7/1990 Spinelli
5,002,816 A * 3/1991 Hofmann et al. ..... 428/138
5,054,254 A * 10/1991 Sells ..... 52/199
5,673,521 A 10/1997 Coulton et al.
5,738,581 A * 4/1998 Rickert et al. ..... 454/365
5,772,502 A * 6/1998 Smith ..... 454/365
5,902,432 A 5/1999 Coulton et al.
5,960,595 A 10/1999 McCorsley, III et al.
6,203,424 B1 * 3/2001 Gallant ..... 454/365
6,277,024 B1 8/2001 Coulton
6,298,613 B1 10/2001 Coulton et al.
6,308,472 B1 10/2001 Coulton et al.
6,361,434 B1 * 3/2002 Brandon ..... 454/365

(Continued)

FOREIGN PATENT DOCUMENTS

GB 2186898 A * 8/1987

OTHER PUBLICATIONS

MWI Components, Uni-Vent, The Universal Ventilation System, 2 page brochure, Jan. 2005.

*Primary Examiner*—Steven B. McAllister
*Assistant Examiner*—Patrick F. O'Reilly, III
(74) *Attorney, Agent, or Firm*—Howson & Howson LLP

(57) ABSTRACT

A roof ridge vent has a pair of opposed, spaced-apart, elongate strips of ventilation material providing ventilation passageways transversely therethrough and forms opposed longitudinally-extending sides of the vent. The elongate ventilation strips are interconnected by a plurality of supports extending transverse relative to the elongate ventilation strips. Each adjacent pair of supports defines an opening therebetween such that an underlying roof surface is visible to an installer through the openings. A vent assembly and method of installation are provided.

34 Claims, 5 Drawing Sheets

U.S. PATENT DOCUMENTS

| | | | | |
|---|---|---|---|---|
| 6,623,354 | B2 * | 9/2003 | Morris et al. | 454/365 |
| 6,662,510 | B2 | 12/2003 | Rotter | |
| 6,981,916 | B2 | 1/2006 | Coulton | |
| 7,219,473 | B2 | 5/2007 | Mantyla et al. | |
| 2004/0031204 | A1 * | 2/2004 | Thompson | 49/501 |
| 2005/0090197 | A1 * | 4/2005 | Coulton | 454/365 |
| 2005/0136831 | A1 | 6/2005 | Coulton | |
| 2006/0040608 | A1 | 2/2006 | Coulton | |
| 2006/0079173 | A1 | 4/2006 | Coulton et al. | |
| 2006/0154597 | A1 | 7/2006 | Coulton et al. | |
| 2007/0000192 | A1 | 1/2007 | Mantyla et al. | |

* cited by examiner 34
32a
44
36
42
46
36
32
34
"B"
36
32b
30a
36
30
30c
34
40

ROOF RIDGE VENT, ASSEMBLY AND METHOD OF INSTALLATION

CROSS-REFERENCE TO RELATED APPLICATIONS

This application claims the benefit under 35 USC §119(e) of U.S. Provisional Patent Application No. 60/714,558, filed Sep. 7, 2005.

BACKGROUND OF THE INVENTION

The present invention relates to a roof ridge vent that enables circulation of air between a roof of a building and an underlying ceiling structure, and more particularly, the present invention relates to a vent, a roof ridge vent assembly, and a method of installing a vent on a roof ridge.

It is useful, and in many locales a building code requirement, that the attic area of a building be provided with a means to permit air exchange. The ventilation prevents undue heat buildup that can render the living quarters of the building uncomfortable and that can impose unreasonable energy requirements for cooling. Proper ventilation of the attic area also preserves the structural integrity of the roof and roof coverings.

One method of venting a roof structure consists of applying a venting media over an elongate open slot formed along a roof ridge. These types of vents are known as ridge vents and enable hot and/or moist air to rise and escape from the attic area uniformly along the length of the roof ridge. Examples of ridge vents are provided by U.S. Pat. No. 5,960,595 issued to McCorsley et al., U.S. Pat. No. 6,298,613 B1, U.S. Pat. No. 6,308,472 B1, U.S. Pat. No. 5,902,432 and U.S. Pat. No. 5,673,521 issued to Coulton et al., U.S. Pat. No. 6,277,024 B1 issued to Coulton, and U.S. Pat. No. 4,942,699 issued to Spinelli and U.S. Patent Applications Publications Nos. 2005/0136831 A1 and 2005/0090197 A1 of Coulton. Each of the above referenced patents and published applications are owned, or co-owned, by Benjamin Obdyke, Inc., the assignee of the present application. U.S. Pat. No. 4,876,950 issued to Rudeen and U.S. Pat. No. 6,662,510 B2 issued to Rotter provide examples of other roof ridge ventilation systems.

While the roof ridge vents disclosed in the above referenced patents may function in an acceptable and/or superior manner, there continues to be a need for alternatives with respect to the design, manufacture and installation of roof ridge vent products. A desired vent should permit a sufficient amount of ventilating air flow without compromising weather infiltration resistance and should be capable of being properly installed in a manner requiring labor skills possessed by the average roof installer. In addition, the vent should be capable of efficient manufacture from inexpensive materials.

BRIEF SUMMARY OF THE INVENTION

The present invention provides a roof ridge vent having a pair of spaced-apart elongate strips of ventilation material each extending in an opposite longitudinally-extending side of the vent and providing ventilation passageways transversely therethrough. The elongate ventilation strips are interconnected by a plurality of supports extending transverse relative to the elongate ventilation strips. Each adjacent pair of supports defines an opening therebetween such that an underlying roof surface is visible to an installer through the openings.

According to another aspect of the present invention, a roof ridge vent assembly is provided. The assembly includes a roof having a ridge with an elongate open slot, a ridge vent secured to the roof overlying the ridge and open slot, and an exterior cap material overlying the ridge vent. The vent has a pair of opposed, spaced-apart, elongate strips of ventilation material extending on the roof substantially parallel to the elongate open slot on opposite sides of the elongate open slot. Each strip has ventilation passageways extending transversely therethrough. The strips are interconnected by a plurality of supports which each extends transversely relative to the strips from one of the strips to the other of the strips above and across the elongate open slot of the roof ridge. The supports support the exterior roofing cap material, such as cap shingles, above the open slot, and each adjacent pair of supports are spaced-apart and define an opening therebetween. The openings enable ready installation of the vent on the roof ridge since the open slot is visible through the openings between the supports.

According to a further aspect of the present invention, a method of installing a roof ridge vent is provided. A pair of elongate strips of ventilation material is placed along opposite sides of an open elongate slot formed along a roof ridge. Each strip has ventilation passageways extending transversely therethrough. The pair of strips is interconnected by a plurality of supports extending transversely relative to the strips from one of the strips to the other of the strips above and across the elongate open slot of the roof ridge. Each adjacent pair of supports is spaced-apart and defines an opening therebetween. During installation, the open elongate slot of the roof ridge is viewed through the openings between the supports to ensure proper alignment of the openwork material on the roof ridge. Thereafter, the vent is secured to the roof ridge with nails or like fasteners and is capable of supporting cap shingles or the like thereon.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE INVENTION

Figure 1:
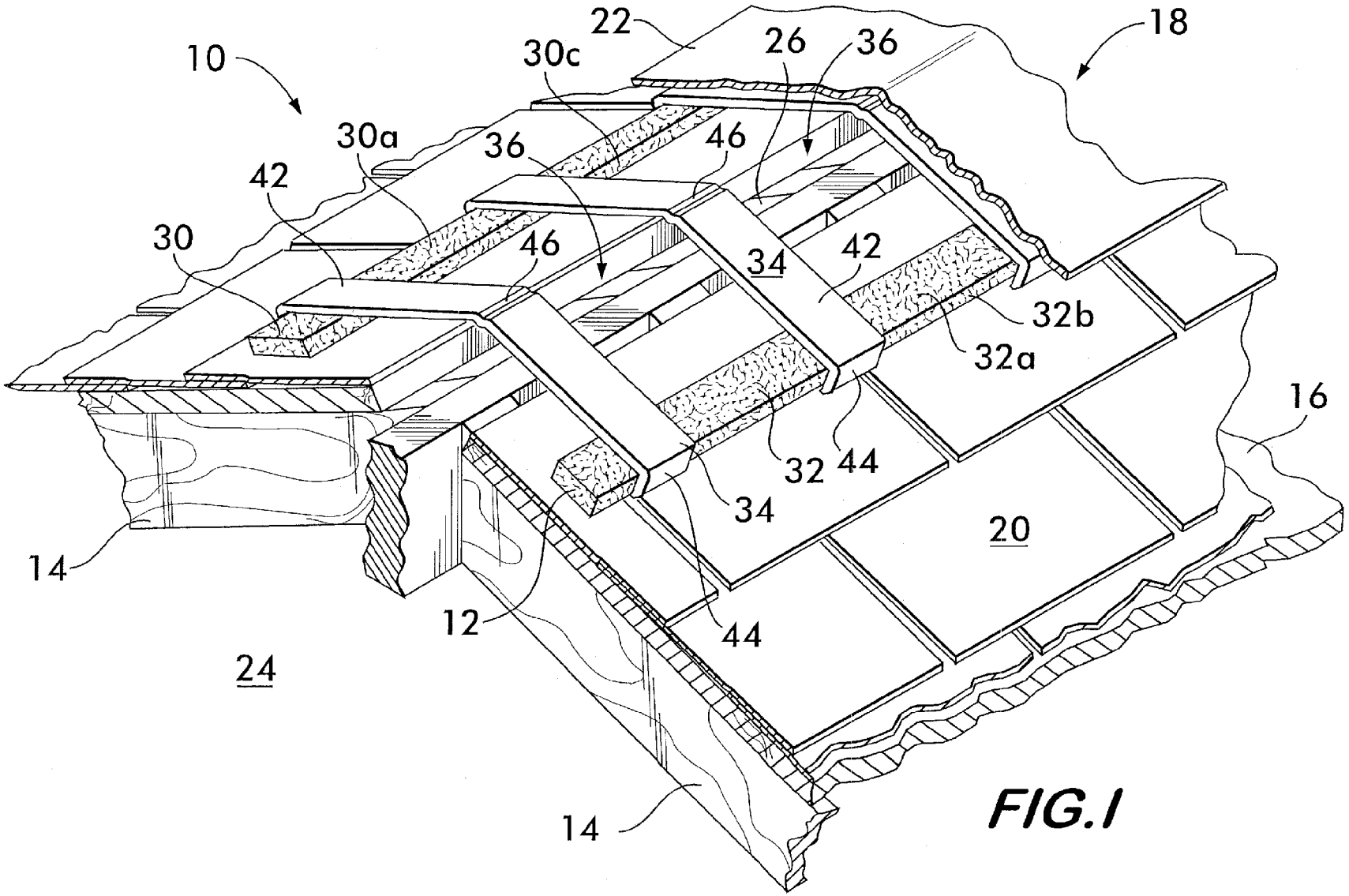
FIG. 1 is a partially-cutaway perspective view of a roof ridge vent assembly according to the present invention.
Figure 2:
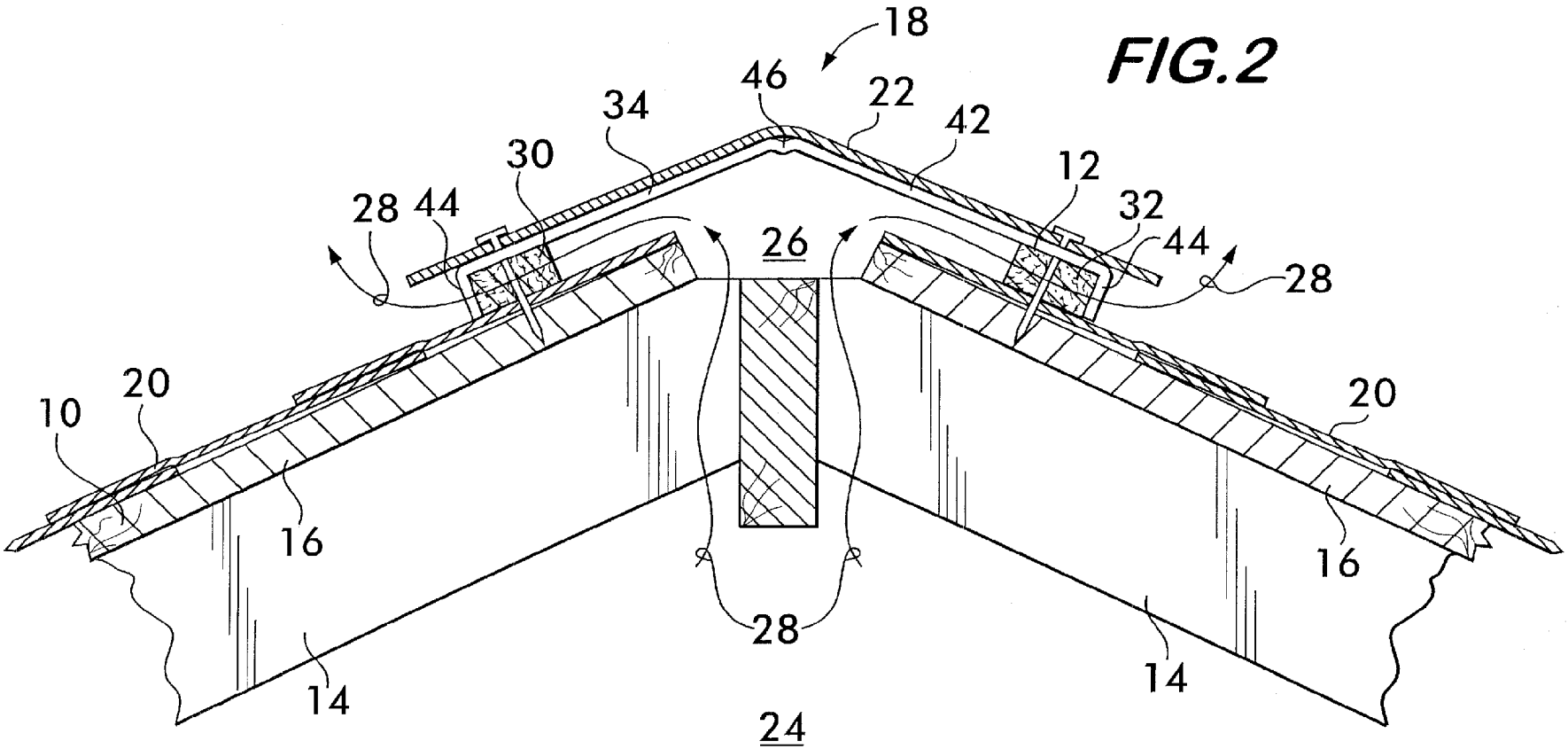
FIG. 2 is an elevational cross-sectional view of the roof ridge vent assembly of FIG. 1.

Referring now to the drawings, FIGS. 1 and 2 illustrate a roof 10 having a typical construction which utilizes a ridge vent 12. The roof 10 is constructed from a plurality of rafters 14 supported at their lower ends, for instance, by exterior walls (not shown) of a building such as a house. A roof deck 16, typically constructed of plywood or other suitable panels, is supported on the rafters. As best illustrated in FIG. 2, the roof deck 16 is sloped and forms a ridge, or peak, 18. Shingles 20 or other exterior roofing materials are secured to the roof deck 16 to finish the sloping portions of the roof 10 in accordance with conventional construction practices. A cap or multiple cap shingles 22, or other exterior roofing materials, are installed overlying the ridge vent 12 to cover the roof ridge 18 and provided a finished appearance.

Air exchange from an attic area 24 underlying the roof 10 to ambient atmosphere is provided via an open elongate slot 26 provided continuously or continually along the length of the roof ridge 18. As best illustrated by arrows 28 in FIG. 2, hot and/or moist air in the attic 24 is permitted to escape through the slot 26 and through the vent 12 to ambient atmosphere. Soffit vents (not shown) located in eaves (not shown) of the roof 10 can be utilized to draw ambient air into the attic space 24 to replace the hot and/or moist air vented via the ridge vent 12.

The roof ridge vent 12 according to the present invention includes a pair of elongate strips 30 and 32 of ventilation material. The strips are spaced-apart such as by a distance "A" shown in FIG. 3 and preferably extend substantially parallel to one another forming opposite longitudinally-extending sides of the vent 12. The spacing "A" ensures that the strips 30 and 32 can be located on opposite sides of the elongate slot 26 of the roof ridge 18. Preferably, each strip 30 and 32 is continuous along the full length of the vent 12. Alternatively, each strip 30 and 32 can be formed of multiple sections that overlap or are bonded together in an end-to-end configuration or with intervening end connectors. By way of example, the strips of ventilation material can be foam, reticulated foam, a mesh of filaments, a mat of filaments, an air-permeable fabric, a screen, a corrugated material, an openwork material, a perforated material, a material having a plurality of baffles, or any other type of material that has ventilation passageways extending transversely therethrough to permit air exchange.

The pair of elongate strips 30 and 32 of ventilation material are interconnected by a plurality of supports 34. As illustrated, the supports 34 are provided as separate straps of material extending transversely, such as perpendicularly, to the strips 30 and 32. Although not illustrated, the supports 34 can extend at angles other than at right angles relative to the ventilation strips 30 and 32; alternatively, the supports 34 can be V-shaped, S-shaped, and C-shaped or have other arcuate or non-straight line shapes in plan. Preferably, the supports 34 are spaced-apart such as by a distance "B" (see FIG. 4) and form openings 36 extending throughout the height "H" of the vent 12. The spacing "B" between adjacent supports 34 is selected to ensure that the supports 34 provide adequately sized openings 36 for ready viewing of an underlying surface therethrough, yet also provide adequate support to cap shingles 22 on the vent 12 to prevent the cap shingles 22 from undesirable inward bowing where the cap shingles 22 extend over the openings 36.

By way of example, the supports 34 can be made of plastic, thermoplastic, rubber, an elastomeric material, fabric, cardboard, metal, a mesh material, or any other material that can be used to support cap shingles 22 or the like thereon. In some contemplated embodiments of the present invention, each support 34 extends from an upper surface 30*a* of strip 30 to an upper surface 32*a* of strip 32 and is secured to the strips 30 and 32 of ventilation material during manufacture of the vent 12. For example, the supports can be adhesively secured or thermally bonded to the strips of ventilation material. Alternatively, the supports 34 can have depending baffles, prongs, fasteners, or the like that extend through or around the ventilation material to mechanically fasten the ventilation material to the supports via a press fit, friction fit, or like connection.

The illustrated embodiments of the vents according to the present invention resemble a ladder or rail road track configuration. The openings 36 are sufficiently large to enable the underlying slot 26 to be readily visible to an installer of the vent 12 to simplify proper alignment and installation of the vent 12 on the roof ridge 18. This configuration also enables material cost savings in producing the vent and enables the vent to be lightweight for efficient and cost effective shipping and handling.

Each support 34, as illustrated, has a crosswise component 42 for extending across the gap "A" between the spaced-apart strips 30 and 32 of ventilation material and a pair of legs 44 depending from the crosswise component 42. The legs 44 can be provided to prevent undesired compression of the strips 30 and 32 of ventilation material due to pressures exerted on the vent when the vent 12 is secured to the ridge 18 and when cap shingles 22 are secured on the vent 12 to the roof 10. In the illustrated embodiment, the legs 44 extend along peripheral outer side edges 30*b* and 32*b* of the strips 30 and 32 of ventilation material. Alternatively, the legs 44 can extend along the inner side edges 30*c* and 32*c* of the strips 30 and 32, or directly through the strips 30 and 32.

Figure 5:
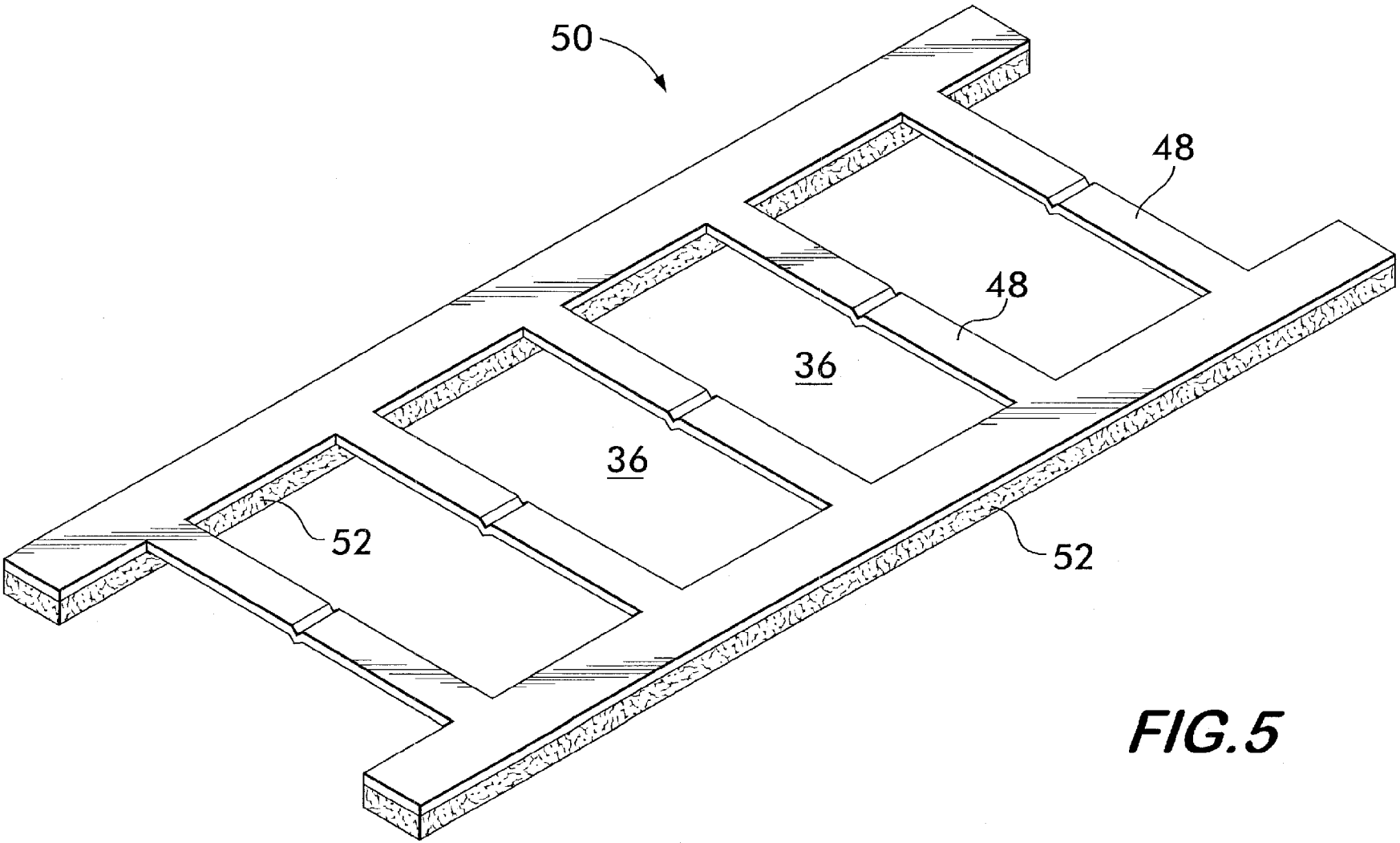
FIG. 5 is perspective view of another alternate embodiment of a roof ridge vent according to the present invention.

An alternate embodiment of a vent according to the present invention is illustrated in FIG. 5. The supports 48 of the vent 50 are interconnected at the ends thereof and form a single integral support piece. As an alternative, a netting material (not shown) could be used as an integral support piece. Baffles, prongs, fasteners, or the like (not shown) can depend from supports 48 and can be used to mechanically secure separately-produced ventilation strips 52 to the supports 48, or the strips 52 could be adhesively secured or thermally bonded to the supports 48. Yet another alternative is to form the entire vent, including the supports and ventilation strips, as an integral piece. For instance, the vent can be molded of plastic with the ventilation strips being provided as a series of spaced-apart integrally-formed baffles depending from the supports.

In some contemplated embodiments of the present invention, such as that illustrated in FIG. 5, the supports can be provided without legs and can simply comprise a crosswise component. In such an embodiment the strips 52 of ventilation material have a composite strength in compression sufficient to support overlying cap shingles and do not require additional support.

Preferably, the crosswise components of the supports 34 and 48 are sufficiently flexible to conform to a substantially inverted-V shape of a roof ridge (see FIG. 2). For example, the support 34 has a hinge 46 formed as a central transverse groove in the crosswise component 42. In yet another contemplated embodiment, the hinges 46 of the supports 34 are interconnected by a longitudinally-extending spine (not shown). The centrally-located longitudinally-extending spine can be used to provide additional support for cap shingles positioned on the vent.

The crosswise component 42 can also be provided with means (not shown) to permit lengthwise expansion or contraction of the supports 34 so that the spacing "A" between opposed strips 30 and 32 can be adjusted. For example, the crosswise component 42 can be formed of two separate slider components which can be slid together to reduce the length "L" of the support 34 or be slid apart to expand the length "L" of the support 34. Alternatively, the crosswise component 42 can have an expandable/contractible accordion structure, notched structure, elastic element, honeycomb element or the like enabling adjustment of the length "L" of the crosswise component 42. The adjustability of the length "L" of the supports 34 enables the vent 12 to be used with various sizes of slots 26 and cap shingles 22 that are within a wide range of widths.

A weather barrier material (not shown) can be provided on the peripheral side edges of the vent 12 to prevent blowing snow and the like to pass through the strips 30 and 32 of the ventilation material. For example, an air permeable filter material made of fabric, non-woven fabric, non-wicking hydrophobic fabric, a mat of filaments, an air permeable foam plastic, a screen, or any other material having a multiplicity of closely spaced openings permitting the flow of air therethrough can be used for this purpose.

A method of installing the ridge vent 12 according to the present invention includes placing the vent 12 over the open slot 26 along the roof ridge 18. The vent 12 is positioned such that the strips 30 and 32 of the ventilation material are located parallel to and on opposite sides of the slot 26 and the supports 34 extend above and transversely across the slot 26. The installer of the vent visually inspects alignment of the vent 12 with the slot 26 and roof ridge 18 via the openings 36 located between the supports 34. Thus, the inspection via the openings 36 enables ready and proper alignment and precise centering of the vent 12 on the roof ridge 18 before nails or like fasteners are used to secure the vent 12 to the roof deck 16.

Figure 3:
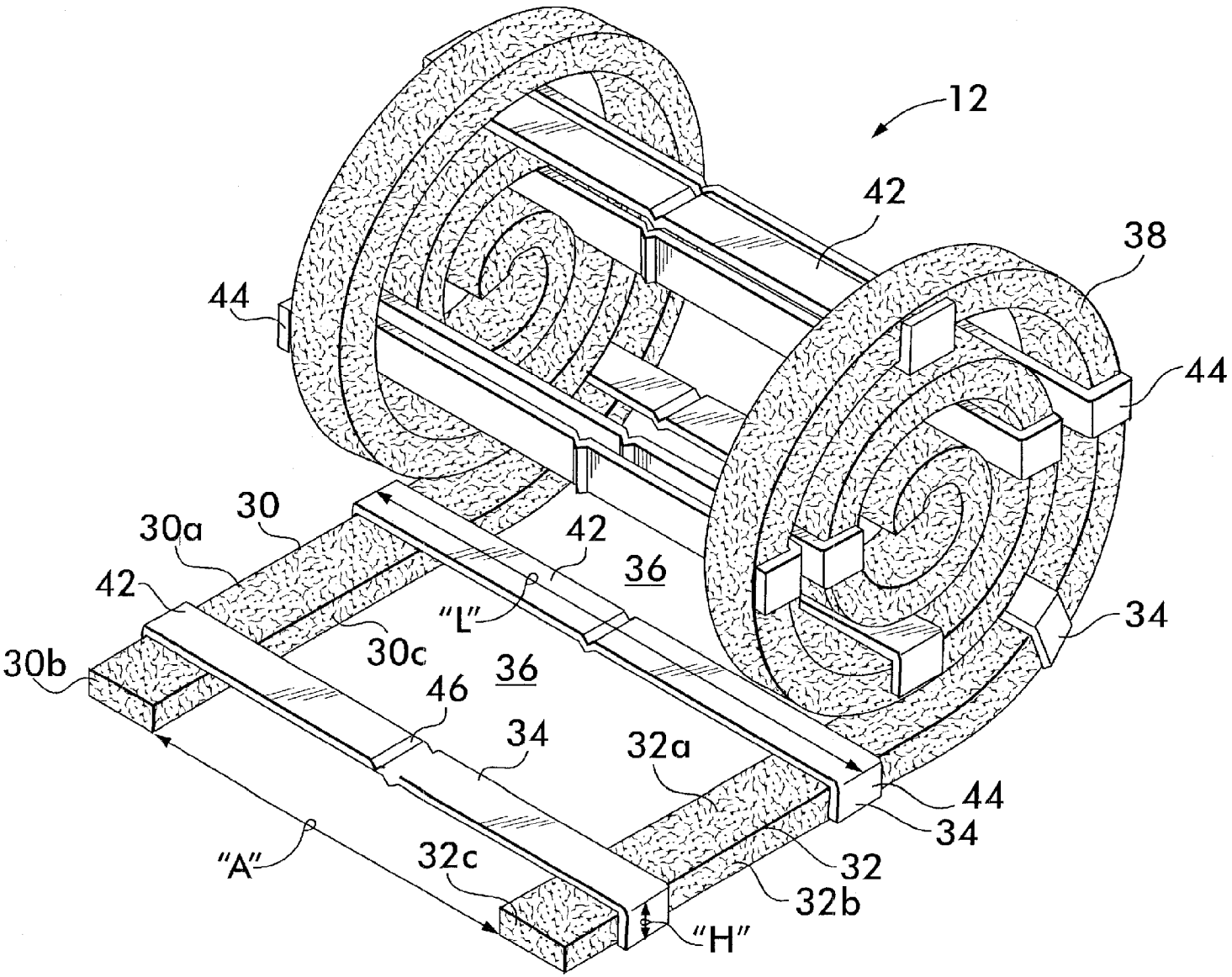
FIG. 3 is a perspective view of a spiral roll of a roof ridge vent according to the present invention.
Figure 4:
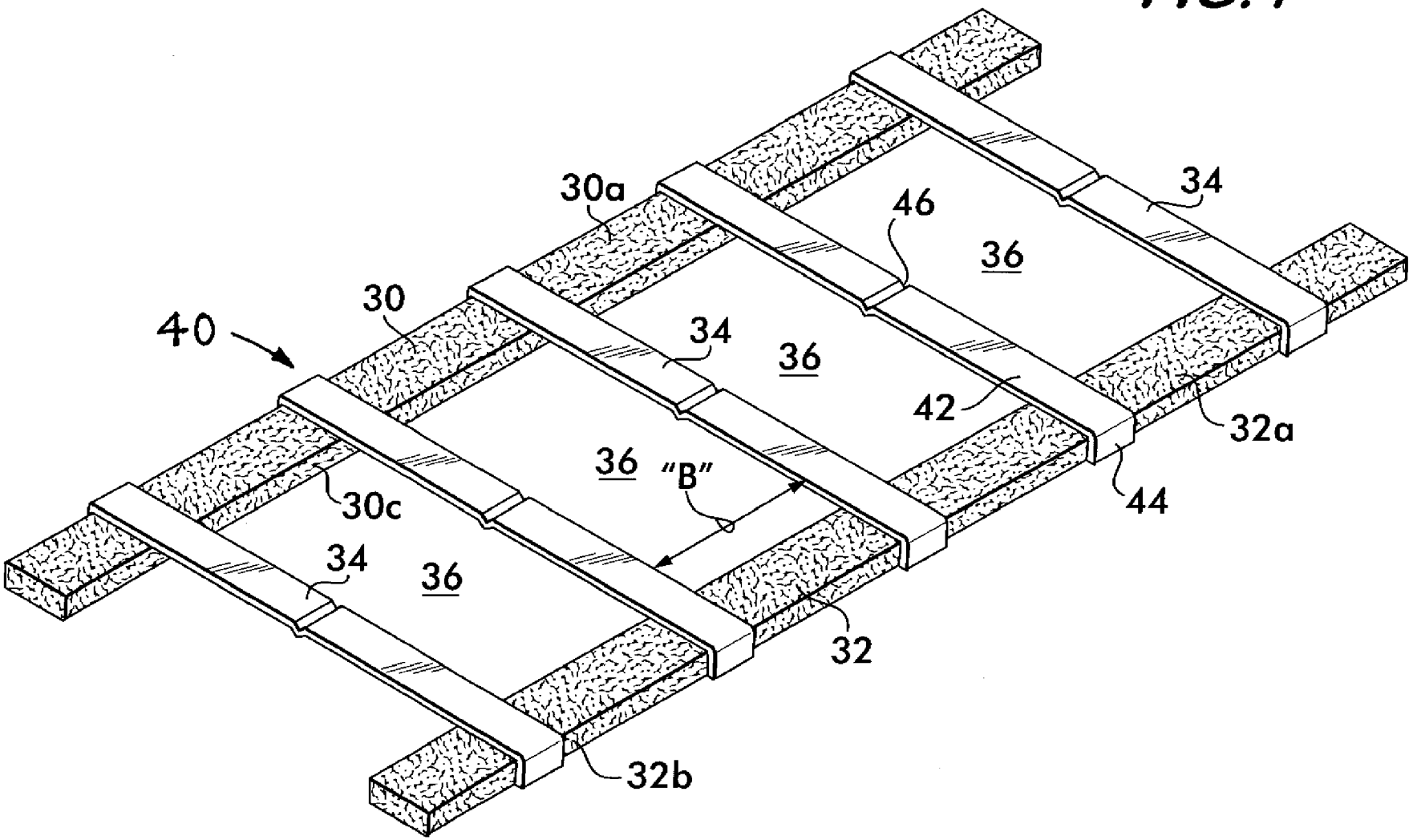
FIG. 4 is perspective view of an alternate sectional roof ridge vent according to the present invention.

As illustrated in FIG. 3, the vent 12 can be provided in a spiral roll 38 and unrolled lengthwise on the roof ridge 18 to form a continuous vent structure. Alternatively, the vents 12 can be provided in sections 40 as illustrated in FIG. 4 and can be installed end-to-end across the roof ridge 18. In addition, the method of installation can include adjusting the length of the supports 34 and/or the size of the gap "A" between strips 30 and 32 of ventilation material as discussed above by expanding and/or contracting the crosswise component 42 of the supports 34.

After the vent 12 is secured to the roof ridge 18, cap shingles 22 or like exterior roofing materials are applied thereon. Alternatively, the vent can be pre-assembled with a water resistant covering or exterior roofing material. In this case, the vent and cap material can be applied on the roof ridge in a single step. Examples of water resistant outer coverings include a thermoset single-ply roofing membrane, a thermoplastic single-ply roofing membrane, a modified bitumen roofing membrane, and a plurality of cap shingles.

The above-described roof ridge vents and assembly according to the present invention provide a uniquely constructed vent that is easy to install, is inexpensive to manufacture, provides a desired amount of air flow therethrough, and prevents weather infiltration.

While preferred roof ridge vents, roof ridge vent assemblies, and methods of their installation have been described in detail, various modifications, alterations, and changes may be made without departing from the spirit and scope of the present invention as defined in the appended claims.

The invention claimed is:

1. A roof ridge vent, comprising:

a pair of spaced-apart elongate strips of ventilation material each extending in an opposite longitudinally-extending side of the vent and providing ventilation passageways transversely therethrough; and a plurality of substantially rigid supports extending transversely relative to said strips and interconnecting said strips, each of said supports extending from an upper surface of one of said strips of ventilation material to an upper surface of the other of said strips of ventilation material, each of said supports having depending legs and each adjacent pair of supports being spaced apart and defining an opening therebetween;

each opening extending through said vent in a direction from a top of the vent to an underside of the vent between said adjacent pair of supports and said pair of spaced-apart strips of ventilation material, and each opening permitting surfaces underlyng said vent to be visible to an installer through said opening.

2. A roof ridge vent according to claim 1, wherein each strip is continuous and extends substantially parallel to the other strip.

3. A roof ridge vent according to claim 1, wherein said strips and supports are integrally formed as a single piece.

4. A roof ridge vent according to claim 3, wherein said ventilation material is a plurality of baffles.

5. A roof ridge vent according to claim 1, wherein said strips and supports we separate items assembled together to form the vent.

6. A roof ridge vent according to claim 5, wherein said plurality of supports are interconnected forming a single integral component.

7. A roof ridge vent according to claim 6, wherein said plurality of supports are interconnected at the ends thereof or between the ends thereof by a longitudinally-extending spine.

8. A roof ridge vent according to claim 5, wherein each of said plurality of supports is a separate strap of material.

9. A roof ridge vent according to claim 5, wherein said strips of ventilation material and said supports are secured together via at least one of an adhesive, a thennally bonded connection, a press fit connection, a friction fit connection, or a fastener that extends through or around said strip.

10. A roof ridge vent according to claim 5, wherein each strip of ventilation material is made of a material selected from a group consisting of foam, reticulated foam, mesh of filaments, mat of filaments, air-permeable fabric, screen, corrugated material, openwork material, a perforated material, and a material having a plurality of depending baffles.

11. A roof ridge vent according to claim 10, wherein each strip of ventilation material has a composite strength in compression sufficient to support an overlying cap shingle.

12. A roof ridge vent according to claim 5, wherein each of said supports is made of a material selected from a group consisting of plastic, thermoplastic, rubber, elastomeric, fabric, cardboard, metal, and mesh material.

13. A roof ridge vent according to claim 1, wherein each of said supports is longitudinally expandable and/or compressible to permit adjustment of the spacing between said opposed strips of ventilation material.

14. A roof ridge vent according to claim 1, wherein each of said supports is sufficiently flexible to conform to a substantially inverted-V shape of a roof ridge.

15. A roof ridge vent according to claim 1, wherein each of said supports extends substantially perpendicular to said strips of ventilation material.

16. A roof ridge vent according to claim 1, wherein said legs extend along an outer peripheral side of said strips of ventilation material, an inner peripheral side of said strips of ventilation material, or through said strips of ventilation material.

17. A roof ridge vent according to claim 1, further comprising an air permeable filter material on a peripheral side edge of the vent to prevent weather infiltration.

18. A roof ridge vent according to claim 17, wherein said filter material is a fabric, a non-woven fabric, a non-wicking hydrophobic fabric, a mat of filaments, an air permeable foam plastic, a sereen, or a material having a multiplicity of closely spaced openings permitting the flow of air therethrough.

19. A roof ridge vent according to claim 1, wherein a continuous length of the vent is rollable lengthwise into a spiral roll for storage and transport.

20. A roof ridge vent according to claim 1, wherein the vent is a sectional vent adapted to be installed end-to-end with like vents to form an elongate ridge vent.

21. A roof ridge vent according to claim 1, further comprising a water resistant covering secured to a top of the vent, said water resistant outer covering being a thermoset single-ply roofing membrane, a thermoplastic single-ply roofing membrane, a modified bitumen roofing membrane, or a plurality of cap shingles.

22. A roof ridge vent assembly, comprising a roof having a ridge with an elongate open slot, a ridge vent secured to said roof overlying said ridge and open slot, and an exterior cap material overlying said ridge vent, said vent comprising:

a pair of opposed, spaced-apart, elongate strips of ventilation material extending on said roof substantially parallel to said elongate open slot on opposite sides of said elongate open slot, each strip having ventilation passageways extending transversely therethrough; and a plurality of substantially rigid supports extending transversely relative to said strips from one of said strips to the other of said strips above and across said elongate open slot on said roof ridge, said supports interconnect said strips and support said exterior cap material above said roof ridge, each of said supports extending from an upper surface of one of said strips of ventilation material to an upper surface of the other of said strips of ventilation material, each of said supports having depending lees that extend to said roof on opposite sides of said elongate open slot of said roof ridge and each adjacent pair of supports being spaced apart and defining an opening therebetween;

each opening extending through said vent in a direction from a top of the vent to an underside of the vent between said adjacent pair of supports and said pair of spaced-apart strips of ventilation material, and each opening permitting the elongate open slot of said roof ridge to be visible to an installer of said vent through said opening.

23. An assembly according to claim 22, wherein each strip is continuous and extends substantially parallel to the other strip.

24. An assembly according to claim 22, wherein said strips and supports are integrally formed as a single piece.

25. An assembly according to claim 22, wherein said strips and supports are separate items assembled together to form the vent.

26. An assembly according to claim 25, wherein said plurality of supports are interconnected forming a single integral component.

27. An assembly according to claim 25, wherein each of said plurality of supports is a separate strap of material.

28. An assembly according to claim 25, wherein said strips of ventilation material and said supports are secured together via at least one of an adhesive, a thermally bonded connection, a press fit connection, a friction fit connection, or a fastener that extends through or around said strip.

29. An assembly according to claim 25, wherein each strip of ventilation material is made of a material selected from a group consisting of foam, reticulated foam, mesh of filaments, mat of filaments, air-permeable fabric, screen, corrugated material, openwork material, a perforated material, and a material having a plurality of depending baffles.

30. An assembly according to claim 22, wherein each of said supports is made of a material selected from a group consisting of plastic, thermoplastic, rubber, elastomeric, fabric, cardboard, metal, and mesh material.

31. An assembly according to claim 22, wherein each of said supports is longitudinally expandable and/or compressible to permit adjustment of the spacing between said opposed strips of ventilation material.

32. An assembly according to claim 22, further comprising an air permeable filter material on peripheral side edges of said vent to prevent weather infiltration.

33. An assembly according to claim 22, wherein said ridge vent is secured to said roof ridge as a continuous, integral unit.

34. An assembly according to claim 22, wherein said ridge vent is secured to said roof ridge as separate sections positioned end-to-end.

* * * * *

UNITED STATES PATENT AND TRADEMARK OFFICE

CERTIFICATE OF CORRECTION

PATENT NO. : 7,393,273 B2
APPLICATION NO. : 11/470518
DATED : July 1, 2008
INVENTOR(S) : Ehrman et al.

It is certified that error appears in the above-identified patent and that said Letters Patent is hereby corrected as shown below:

Column 6, line 9 “supports we separate” should read “supports are separate”

Column 6, line 21 “a thennally bonded” should read “a thermally bonded”

Column 7, line 23 “lees that extend” should read “legs that extend”

Signed and Sealed this

Twenty-fifth Day of November, 2008

JON W. DUDAS
*Director of the United States Patent and Trademark Office*